US005174464A

United States Patent [19]

Watt

[11] Patent Number: 5,174,464

[45] Date of Patent: Dec. 29, 1992

[54] PAINT OR SIMILAR CAN WITH OVERCAP

[75] Inventor: Ramon C. Watt, Lockport, N.Y.

[73] Assignee: All-Pak, Inc., Pittsburgh, Pa.

[21] Appl. No.: 820,237

[22] Filed: Jan. 14, 1992

[51] Int. Cl.[5] ..... B65D 51/18

[52] U.S. Cl. ..... 220/256; 220/319; 220/354; 220/358; 220/257

[58] Field of Search ..... 220/256, 352, 354, 355, 220/356, 358, 315, 319, 257, 694, 701, 741

[56] References Cited

U.S. PATENT DOCUMENTS 983,883 2/1911 Eckart .
1,128,076 2/1915 Taliaferro ..... 220/358 X
1,239,183 9/1917 Hodgson ..... 220/256
3,133,669 5/1964 Scholtz .
3,149,743 9/1964 Scholtz .
3,158,282 11/1964 Housz .
3,438,533 4/1969 Hanisch et al. .
3,696,963 10/1972 Saunders ..... 220/315 X
3,834,579 9/1974 LaCroce .
4,520,942 6/1985 Dwinell .
4,607,759 8/1986 Boetzkes .
4,728,003 3/1988 Davey ..... 220/354 X

*Primary Examiner*—Allan N. Shoap
*Assistant Examiner*—Paul A. Schwarz
*Attorney, Agent, or Firm*—Buchanan Ingersoll

[57] ABSTRACT

A paint or similar can adapted to retain its lid in fluid tight condition against mechanical or pressure disturbances. The can has a ring element secured to the top of its sidewall and a lid assembled onto the ring element. Rubber or other sealant is disposed between the ring element and lid to form one or more continuous seals between the ring element and lid. An overcap having a debossment is placed over the lid. Filament reinforced low stretch adhesive tape is adherently applied to the overcap and the sidewall and hold the overcap down tightly against the lid with the debossment pressing against the lid to prevent the lid from backing off from the ring element and breaking the seal.

11 Claims, 2 Drawing Sheets

PAINT OR SIMILAR CAN WITH OVERCAP

BACKGROUND OF THE INVENTION

This invention relates to a metal container for paint, paint thinner or other liquid and more particularly this invention relates to a can for liquid adapted to remain fluid tight under conditions tending to induce loss of a fluid tight seal at the lid of the can.

SUMMARY OF THE INVENTION

Many conditions can arise which tend to cause loss of a fluid tight seal at the lid of a can for paint, paint thinner or other liquid. For example the can be dropped, causing loss of the seal due to mechanical shock. The liquid in the can might produce vapors upon a temperature increase tending to create a pressure increase within the can. Also, the pressure outside of the can may be reduced, such as can occur in the hold of an airplane, tending to cause the lid to pop off or loosen or cause leakage of paint from the can. According to the present invention an overcap is placed over the lid of a paint can and the overcap is held down tightly against the lid by means of adhesive tape extending adherently across the overcap and down the sidewall of the can.

Paint cans commonly have a radially inwardly extending ring element secured to the top of the sidewall of the can and the lid is assembled onto this ring element. It is a further feature of this invention that sealant is placed between the ring element and the lid to form one or a plurality of circular seals between the ring element and the lid. The sealant can be a rubberized compound or other material which is prebaked onto the lid on the one hand and onto the ring element on the other hand so that the sealant permanently adheres to the lid and ring element, respectively, as a manufacturing step prior to assembly of the paint can. The overcap is provided with a debossment which presses against the lid in the vicinity of the sealant to maintain a liquid tight seal along a full circle between the lid and the ring element.

More particularly, the paint can of this invention comprises a cylindrical sidewall with an enclosed bottom with a ring element secured to the top of the sidewall. A ring groove extends in a circular path entirely around the ring element. The area at the top of the can not covered by the ring element defines a circular can opening and a circular lid is used to cover the opening. A lid groove extends in a circular path entirely around the lid and the lid groove is inserted into the ring groove when the lid is assembled onto the ring element. An overcap having a debossment is placed over the assembled lid and ring element and adhesive tape is stuck fast across the overcap and tightly pulled down and stuck fast to the sidewall to hold the overcap firmly down against the lid so that the debossment is in contact with the lid. Some sealant is prebaked onto a surface of the ring element and additional sealant is prebaked onto a surface of the lid so that sealant is stuck tightly to these respective surfaces and forms continuous circular seals between the ring element and the lid.

Still more particularly, the ring element is secured to the top of the sidewall at a circumferential seam and extends radially inwardly from the sidewall. There is a downwardly extending ring groove extending in a circular path entirely around the ring element parallel to the top of the sidewall. The ring groove has a ring groove base and inner and outer ring groove rims. The area at the top of the can not covered by the ring element defines a circular can opening and a circular lid covers the can opening. The circumferential periphery of the lid rests on the ring element. The lid is provided with a downwardly extending lid groove extending in a full circular path parallel to the periphery of the lid and near the periphery of the lid. The lid groove has a lid groove base and inner and outer lid groove rims. The lid groove corresponds with, is inserted into and is frictionally engaged with the ring groove and the lid is thereby assembled onto the ring element. An overcap having a downwardly depending peripheral skirt is disposed over the assembled lid and ring element with the skirt depending snugly along the upper region of the sidewall. A shallow debossment extends in a continuous circular path around the overcap at a position corresponding with the inner and outer rims of the lid groove. Adhesive tape adherently extends across the overcap and down the sidewall to hold the overcap firmly against the lid so that the debossment abuts against the inner and outer rims of the lid groove. A rubber compound or other sealant is adherently secured to the base of the ring groove and also to the underside of the inner rim of the lid groove so that two continuous liquid tight circular seals are created between the lid and the ring element.

When the lid is assembled onto the ring element, the lid is normally held securely onto the ring element by the frictional engagement between the abutting ring groove and lid groove surfaces. While there are multiple points of contact along these groove surfaces which provide a frictional engagement of the lid to the ring element, there will also be gaps between points of contact. These gaps will be large enough to permit leakage of liquids therethrough, especially low viscosity liquids, such as paint thinners, which may be contained within the can. However, the use of a sealant between the lid and ring element completes the liquid seal between the lid and ring element.

This seal will be adequate to maintain the can in fluid tight condition absent any disturbing occurrence such as mechanical jarring or a pressure change inside or outside of the can, which could cause the lid to back off and thereby break the seal. A very slight lifting of the lid can break the seal and permit leakage. The purpose of the overcap is to prevent such a backing off when a disturbance occurs. In order to prevent the lid from backing off, the debossment in the overcap is located above the lid groove so that the debossment abuts against the lid groove to wedge it securely in place in the vicinity of the seal. Also, the tape which secures the overcap is a high strength, low stretch tape. Normal tapes have a 12 to 18 percent stretch before the adhesive will fail. This amount of stretch is normally inadequate in a tape for securing the overcap of this invention.

As stated, the tape used for holding down the overcap is a high strength, low stretch tape. High strength with low stretching can be achieved by using a filament reinforced tape. This type of tape can comprise a polymer, such as polypropylene, which is reinforced with continuous filaments of glass yarn, having an adhesive backing. It is the filament in such a tape that provides increased strength and stretch reduction. The tape is preferably capable of adhering to the can over a temperature range of −40° to 140° F. and is water resistant.

An example of a suitable filament type of adhesive tape is Scotchpar Tape No. 898, which is a transparent tape reinforced with continuous glass yarn filaments. This tape has a thickness of 0.006 inches, a tensile strength of 380 lbs./inch, an adhesion to steel of 50 oz./inch and a stretch of 3 percent. It is manufactured by 3M Packaging Systems Division.

BRIEF DESCRIPTION OF THE DRAWINGS

This invention will be more completely understood by reference to the accompanying drawings in which.

DESCRIPTION OF THE PREFERRED EMBODIMENTS

Figure 1:
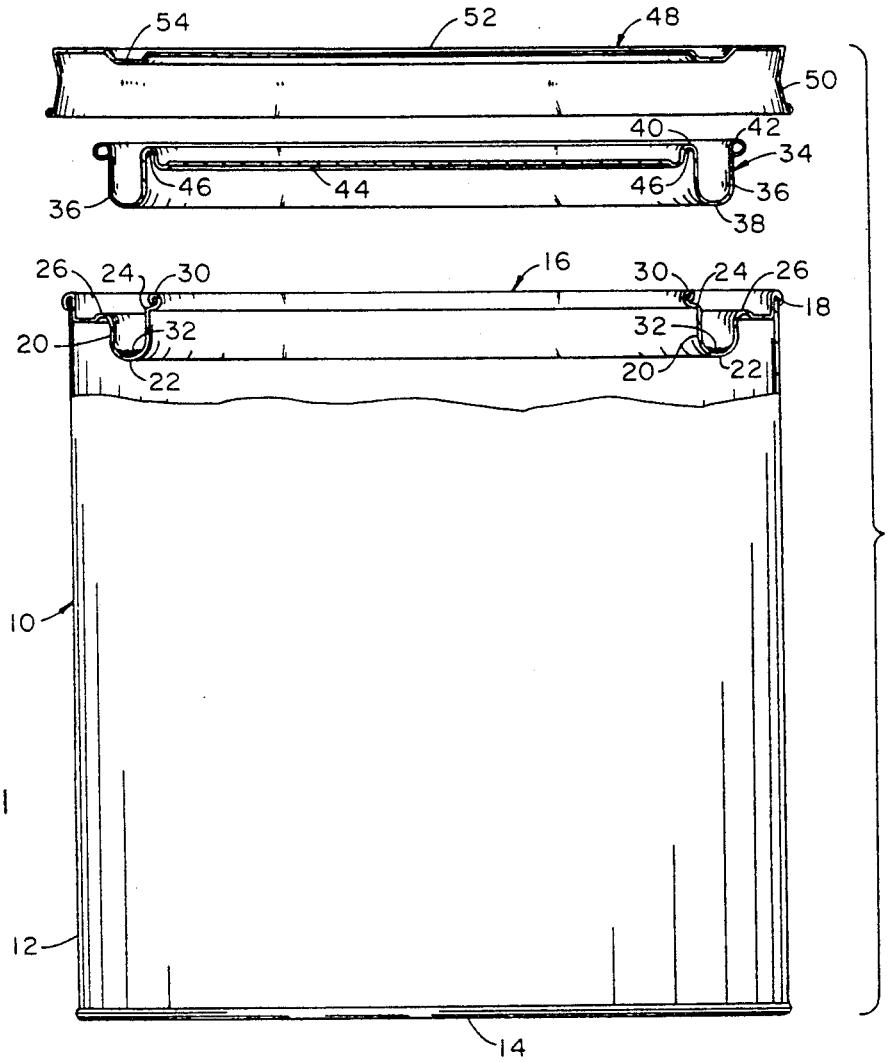
FIG. 1 is an exploded view of the can assembly showing the disassembled can, lid and overcap.

Referring to FIG. 1, paint can 10 includes cylindrical sidewall 12, bottom enclosure 14 and ring element 16. Ring element 16 is joined to sidewall 12 at fluid-tight folding seam 18. Ring element 16 includes a circular ring groove 20 extending as a complete circle around ring element 16. Ring groove 20 has ring groove base 22 and inner and outer ring groove rims 24 and 26, respectively. Curved ring groove inner lip 30 extends upwardly and radially inwardly from inner groove rim 24. A rubber sealant material 32 is prebaked onto and adheres permanently to ring groove base 22.

FIG. 1 shows lid 34 which is provided with lid groove 36 extending as a complete circle around lid 34. Lid groove 36 includes lid groove base 38, lid groove inner rim 40 and lid groove outer rim 42. Lid 34 includes flat cover portion 44 which serves as a cover for the circular top opening of paint can 10. Rubber sealant material 46 is baked onto and adheres permanently to the underside of inner rim 40.

FIG. 1 also shows overcap 48 which includes skirt 50, cover portion 52 and debossment 54. Debossment 54 extends as a complete circle around cover portion 52 at a position corresponding to lid groove 36.

Figure 2:
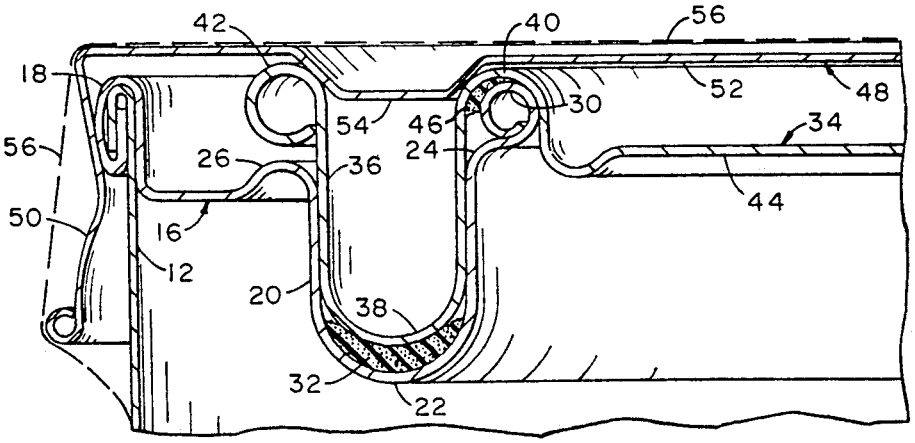
FIG. 2 is a cross-section of a fragment of the assembled can, lid and overcap.

FIG. 2 illustrates the assembled arrangement of ring element 16, lid 34 and overcap 48. As shown in FIG. 2, lid groove 36 fits snugly into ring groove 20 so that rubber element 32 is compressed between base 22 of ring groove 20 and base 38 of lid groove 36 to establish a first continuous liquid tight circular seal. At the same time, separate rubber element 46 is compressed between lip 30 of ring element 16 and inner lip 40 of lid 34 to establish a second continuous fluid tight circular seal.

Figure 3:
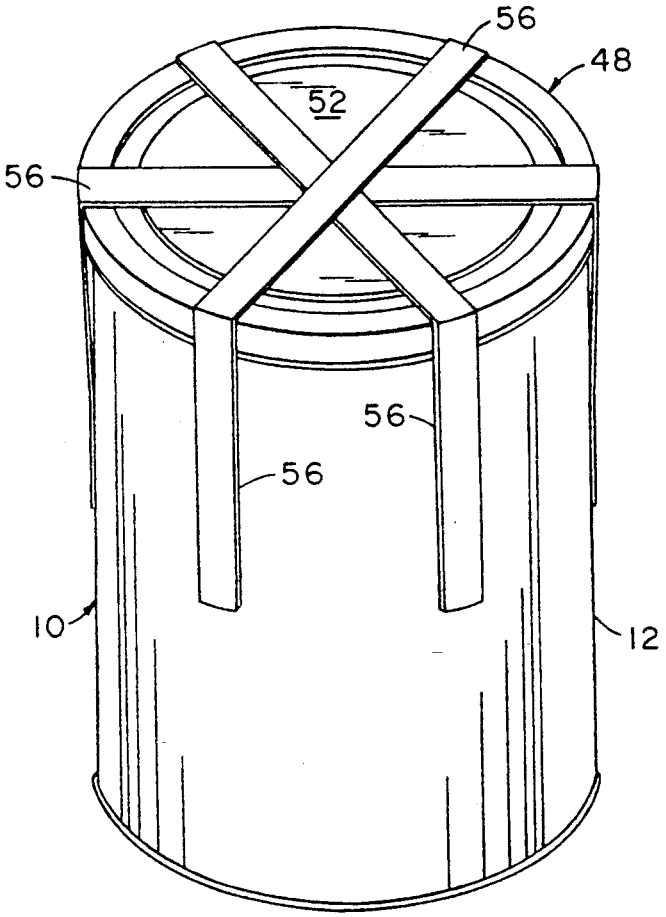
FIG. 3 is an isometric outside view of the completed can assembly.

FIG. 2 shows that the two rubber fluid tight seals are firmly compressed and lid 34 is held securely in place by means of overcap 48 whose debossment 54 in cover portion 52 abuts against inner and outer rims 40 and 42 of lid 34 as skirt 50 of overcap 48 holds overcap 48 in place while abutting springingly against seam 18. Debossment 54 only needs to be deep enough to abut against one or both rims 40 and 42 of lid 34. Commonly, debossment 54 can be about one-sixteenth inch deep. Overcap 48 is more positively secured by means of a plurality of strips 56 of filament reinforced adhesive tape which can adherently crisscross some or all of cover portion 52 of overcap 48 and adherently extend partially down sidewall 12 of the can, as shown in FIG. 3.

I claim:

1. A can for holding liquid comprising a cylindrical sidewall with an enclosed bottom, a radially inwardly extending ring element secured to the top of said sidewall, a ring groove extending in a circular path around said ring element, the area at the top of said can not covered by said ring element defining a circular can opening, a circular lid covering said can opening, a lid groove extending in a circular path around said lid, inner and outer rims at the top of said lid groove, said lid groove inserted into said ring groove in friction tight relationship with said ring groove, an overcap having a depending peripheral skirt, said overcap disposed over the assembled ring element and lid and covering the entire assembled ring element and lid with said skirt depending snugly along the upper region of said sidewall, a debossment in said overcap, adhesive tape extending across said overcap and down said skirt and sidewall to hold said overcap firmly down against said lid so that said debossment is in contact with said lid at the location of said lid groove, said debossment being relatively shallow so that said debossment reaches no deeper than the rim region of said lid groove when said overcap is firmly held down by said adhesive tape, and sealant located between said ring element and lid to form a continuous circular seal between said ring element and lid.

2. The can of claim 1 wherein the sealant is adherently secured within said ring groove.

3. The can of claim 1 wherein said tape is reinforced with filaments for increased strength and reduced stretchability.

4. The can of claim 1 wherein said tape is a polymer tape having glass yarn filaments.

5. The can of claim 1 wherein said tape is capable of adhering to the can at a temperatuare range of −40° to 140° F. and is water resistant.

6. The can of claim 1 wherein the sealant is adherently secured on the underside of said lid.

7. The can of claim 1 wherein the sealant is adherently secured within said ring groove and on the underside of said lid to form continuous circular seals between said ring element and lid.

8. The can of claim 1 wherein said debossment extends in a continuous circular path around said overcap.

9. The can of claim 1 wherein said debossment abuts against the upper region of said lid groove.

10. The can of claim 1 wherein said debossment is about one-sixteenth inch deep.

11. A can for holding liquid comprising a cylindrical sidewall with an enclosed bottom, a ring element secured to the top of said sidewall and extending radially inwardly from said sidewall, a downwardly extending ring groove extending in a circular path along said ring element parallel to the top of said sidewall, said ring groove having a ring groove base and inner and outer ring groove rims, the area at the top of said can not covered by said ring element defining a circular can opening, a circular lid covering said can opening, the circumferential periphery of said lid resting on said ring element, a downwardly extending lid groove extending in a circular path around said lid, said lid groove having a lid groove base and inner and outer lid groove rims, said lid groove corresponding with and inserted into said ring groove when said lid is assembled onto said ring element, an overcap having a cover portion and a downwardly depending peripheral skirt, said overcap disposed over the assembled ring element and lid with said skirt depending snugly along the upper region of said sidewall, a debossment extending in a circular path around said cover portion of said overcap at a position corresponding with the inner and outer rims of said lid groove, filament reinforced polymer tape with a backing of adhesive film extending across said cover portion of said overcap and down said sidewall to hold said overcap firmly down against said lid so that said debossment is in contact with the inner and outer rims of said lid groove, a sealant located at the base of said ring groove and on the underside of the inner rim of said lid groove so that continuous circular seals are created between said lid and said ring element.

* * * * *